US008325966B2

(12) United States Patent
Huang

(10) Patent No.: US 8,325,966 B2
(45) Date of Patent: Dec. 4, 2012

(54) DETACHABLE LOUDSPEAKER STRUCTURE HAVING BOTH AUDIO AND SUPPORTING FUNCTIONS

(75) Inventor: Wen-Hung Huang, Tucheng (TW)

(73) Assignee: Hannspree, Inc., Taipei County (TW)

( * ) Notice: Subject to any disclaimer, the term of this patent is extended or adjusted under 35 U.S.C. 154(b) by 115 days.

(21) Appl. No.: 12/929,176

(22) Filed: Jan. 6, 2011

(65) Prior Publication Data

US 2012/0093352 A1 Apr. 19, 2012

(30) Foreign Application Priority Data

Oct. 19, 2010 (TW) ..... 99135533 A

(51) Int. Cl.
*H04R 25/00* (2006.01)

(52) U.S. Cl. ..... 381/386; 381/388; 381/394

(58) Field of Classification Search ..... 381/300, 381/304, 305, 306, 333, 334, 386, 388, 394, 381/395; 361/679.23, 679.26, 679.55
See application file for complete search history.

(56) References Cited

U.S. PATENT DOCUMENTS

| | | | | |
|---|---|---|---|---|
| 5,633,943 | A * | 5/1997 | Daniels et al. | 381/386 |
| 5,970,161 | A * | 10/1999 | Takashima et al. | 381/386 |
| 6,954,539 | B2 * | 10/2005 | Maruta | 381/385 |
| 2007/0092088 | A1 * | 4/2007 | Chang | 381/79 |

* cited by examiner

*Primary Examiner* — Huyen D Le
(74) *Attorney, Agent, or Firm* — Bacon & Thomas, PLLC

(57) ABSTRACT

A detachable loudspeaker structure including a loudspeaker, a circuit board, a housing and a signal connector, wherein the circuit board is electrically connected to the loudspeaker and the signal connector, the housing forms a receiving space therein for receiving the loudspeaker and circuit board and has a top surface provided with a receiving groove, and the signal connector has one end pivotally connected inside the receiving groove so as for the other end of the signal connector to be rotated out of the receiving groove and connect with an audio output port of a display. Hence, the loudspeaker structure is not only able to be easily installed together with the display for reproducing audio signals received from the display, but also able to firmly support the display on a flat surface, wherever desired without spatial limitations.

1 Claim, 7 Drawing Sheets

DETACHABLE LOUDSPEAKER STRUCTURE HAVING BOTH AUDIO AND SUPPORTING FUNCTIONS

FIELD OF THE INVENTION

The present invention relates to a loudspeaker structure, especially to a detachable loudspeaker structure, which is not only configured to transmit audio signals received from a display, but also able to support the display on a surface (such as a table).

BACKGROUND OF THE INVENTION

Recently, with the rapid development of the display industry, the market of display-related products is no more dominated by the bulky cathode ray tube (CRT) displays but has seen the emergence of all kinds of new displays, such as liquid crystal displays (LCDs), plasma displays, digital displays, analog displays, and so on. Meanwhile, there is a trend for the displays to be increasingly thinner and lighter. Hence, displays have become more and more convenient and indispensable in our daily lives.

However, the loudspeaker structure for displays has not improved correspondingly, mainly because the acoustic waves of a loudspeaker require a loudspeaker box for resonance and thereby enhancing sound propagation. Due to the loudspeaker box, the loudspeaker structure requires a large space and is prevented from being installed where space is limited. Besides, wall-mounted displays have become more and more popular nowadays, but the conventional loudspeaker structure cannot be installed on a wall without using a mount or bracket, which is highly inconvenient. While there are many loudspeaker products on the market that have been improved in design, they still have certain drawbacks in use, as explained hereinafter with reference to two commercially available loudspeaker structures by way of example.

Please refer to FIG. 1 for a conventional loudspeaker structure 1 which includes a rectangular loudspeaker box 11 and a loudspeaker (not shown). The two rectangular loudspeaker boxes 11 shown in FIG. 1 are fixed to two lateral sides of a display 10 respectively. Each loudspeaker box 11 is provided therein with a receiving space for receiving the corresponding loudspeaker. The loudspeakers are electrically connected to the display 10 so as to receive audio signals therefrom. As the loudspeaker structures 1 and the display 10 form as a single unit, the user is spared the inconvenience of having to install additional loudspeakers while using the display 10. However, the loudspeaker structures 1 did not improve the overall design of the display 10. The loudspeaker structures 1 is heavy and bulky, but also add to the load of the supporting base 12 at the bottom of the display 10, thus affecting the overall structure design. Moreover, as the loudspeaker structures 1 are directly fixed to the display 10, maintenance or replacement of the loudspeaker structures 1 will be extremely difficult. The direct fixing of the loudspeaker structures 1 to the display 10 is also unable to adjust the angle of the loudspeaker structures 1. Consequently, the directions of sound propagation cannot be adjusted to produce better sound effect according to personal and environmental needs.

FIG. 2 illustrates another conventional loudspeaker structure relating to a loudspeaker-including base 2 for a display. The loudspeaker-including base 2 includes a supporting frame 21 and a two-unit loudspeaker set 22, wherein the supporting frame 21 is fixedly engaged with a bottom portion of the display. The supporting frame 21 is provided therein with two transmission lines (not shown) which are respectively and electrically connected to an audio input line of the display and the loudspeaker set 22 so as to receive audio signals from the display and transmit the audio signals to the loudspeaker set 22. The loudspeaker set 22 is configured to reproduce the audio signals transmitted through the transmission lines. In addition, the two units of the loudspeaker set 22 are located on two lateral sides of the supporting frame 21 respectively to increase the overall balance of the loudspeaker-including base 2 in supporting the display. However, despite the integration of audio and supporting functions, and hence a significantly increased size of the loudspeaker-including base 2, the loudspeaker set 22 is also unable to adjust the angle between the loudspeaker-including base 2 and the display. Besides, the two units of the loudspeaker set 22 are too close to each other to create a good surround sound effect. While the loudspeaker-including base 2 has both audio and supporting functions, the integration of the loudspeaker set 22 and the supporting frame 21 inevitably limits the performances of both. As a result, the performances of the loudspeaker set 22 and the supporting frame 21 may be less desirable than when the loudspeaker structure is provided separately from the display.

According to the above, the conventional loudspeaker structures shown in FIGS. 1 and 2 do provide improvements over their predecessors but are still lacking, particularly in terms of the overall design of and cooperation between the loudspeaker structure and the display. More specifically, the loudspeaker structures of FIG. 1 are so bulky that the overall volume of the display cannot be reduced. In addition, both the loudspeaker structures in FIGS. 1 and 2 are fixed to the display and therefore do not allow angular adjustment on the loudspeakers. Because of that, it is impossible to adjust the sound propagation directions of the loudspeakers according to the user's needs and environmental requirements, let alone achieve the desired acoustic field. Hence, the issue to be addressed by the present invention is to design a novel loudspeaker structure which not only functions as a supporting base for positioning a display on a plane (e.g., a desktop), with a view to replacing the conventional supporting bases, but also allows the sound propagation direction of a loudspeaker to be freely adjusted according to the user's needs and environmental requirements, so as to produce the desired acoustic field. It is further desired that the loudspeaker structure, when not connected to the display, serves as a standalone loudspeaker and can be placed wherever needed, so that the applicability of the loudspeaker structure is substantially broadened.

BRIEF SUMMARY OF THE INVENTION

In view of the aforesaid problems of the prior art, the inventor of the present invention conducted extensive research and repeated trials and finally succeeded in developing a detachable loudspeaker structure having both audio and supporting functions as disclosed herein. The disclosed loudspeaker structure can adapt to the various modes of use of commercially available displays and features both compactness and good sound propagation properties unattainable at the same time by the conventional loudspeaker structures.

It is an object of the present invention to provide a detachable loudspeaker structure having both audio and supporting functions, wherein the loudspeaker structure includes a loudspeaker, a circuit board, a housing, and a signal connector. The loudspeaker is configured to reproduce audio signals. The circuit board is electrically connected to the loudspeaker and the signal connector via two transmission lines respectively. The housing forms a receiving space therein for receiving the loudspeaker and the circuit board. The housing also has a top surface provided with a receiving groove. The signal connector has one end pivotally connected inside the receiving groove so as for the other end of the signal connector to be rotated out of the receiving groove and connect with an audio output port of a display. Once the signal connector is connected with the audio output port, audio signals can be transmitted from the display to the loudspeaker through the signal connector and the circuit board and be accurately reproduced by the loudspeaker. At the meantime, the display is supported on and firmly connected to the top surface of the loudspeaker structure, thus turning the loudspeaker structure into a supporting base that does not occupy much space. Hence, the display can be easily installed, together with the loudspeaker structure, wherever desired without spatial limitations.

It is another object of the present invention to provide a loudspeaker structure with broad applicability. As displays find more and more applications in our daily lives, displays that can be easily mounted on a wall are gaining as much popularity as their desktop counterparts. Nevertheless, corresponding improvement in the related audio equipment is wanting. If it is desired to hang a loudspeaker structure on a wall alongside a wall-mounted display, an additional mount or bracket must be purchased. And during the installation of the mount or bracket, the user has to operate a fastening tool (e.g., a wrench and screws) or even drill holes on the wall, which not only is laborious but also damages the wall esthetically. As an improvement over the prior art, the disclosed loudspeaker structure can be hung flat on a wall together with the display to which the loudspeaker structure is connected, and this can be easily done by rotating the housing of the loudspeaker structure to a position in which the otherwise protruding portion of the loudspeaker structure is below and in line with the display. Moreover, the housing is further provided with an audio input port electrically connected to the circuit board. Once the signal connector is received in the receiving groove, the loudspeaker structure can receive audio signals through the audio input port from sources other than a display (e.g., a portable audio player or a mobile phone), thus functioning as a standalone loudspeaker. Consequently, applications of the disclosed loudspeaker structure are greatly increased.

Yet another object of the present invention is to allow the user to rotate the housing of the disclosed loudspeaker structure and thereby easily adjust the angle between the loudspeaker structure and a display, with a view to creating the desired surround sound effect. Furthermore, the loudspeaker structure can be placed at two bottom ends of a display so as to minimize the impact of vibrations on the images of the display. Hence, despite its small spatial volume, the disclosed loudspeaker structure is capable of providing the optimal sound propagation effect.

It is still another object of the present invention to provide the plug-and-use signal connector and thereby facilitate the installation and removal of the loudspeaker structure. As long as a display is equipped with a plurality of audio output ports, the disclosed loudspeaker structure can be readily installed at different positions on the display, in contrast to the conventional detachable loudspeaker structures, which can only be installed at fixed positions. In addition, as the displays for use with the disclosed loudspeaker structure do not need supporting bases or related connecting elements, the goal of providing thin and lightweight displays can be easily achieved, even at a reduced production cost.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
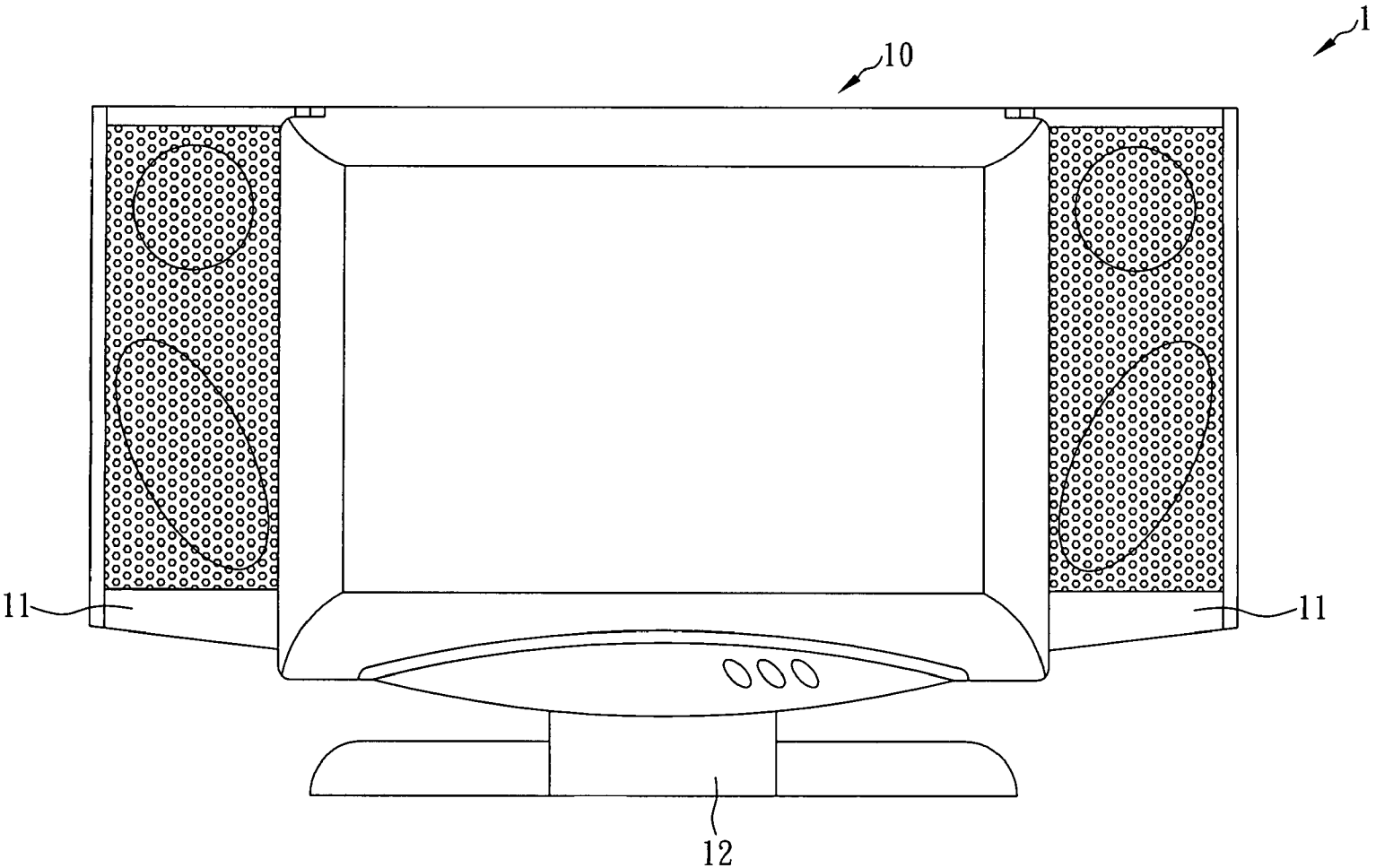
FIG. 1 (Prior Art)
FIG. 1 schematically shows a conventional loudspeaker structure for use with a display.
Figure 2:
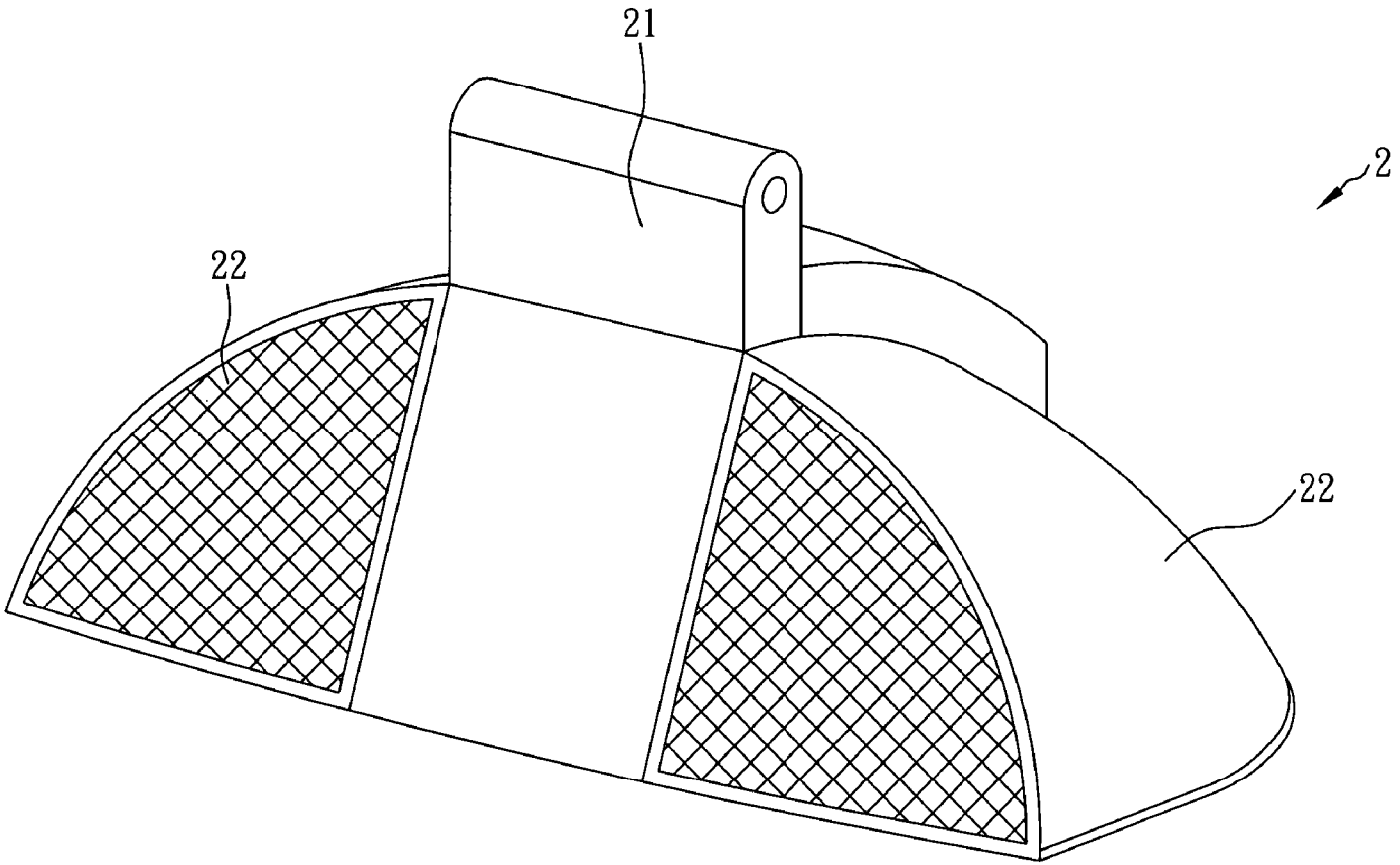
FIG. 2 (Prior Art)
FIG. 2 is a perspective view of a loudspeaker-including base for a display existing in the prior art.
Figure 3:
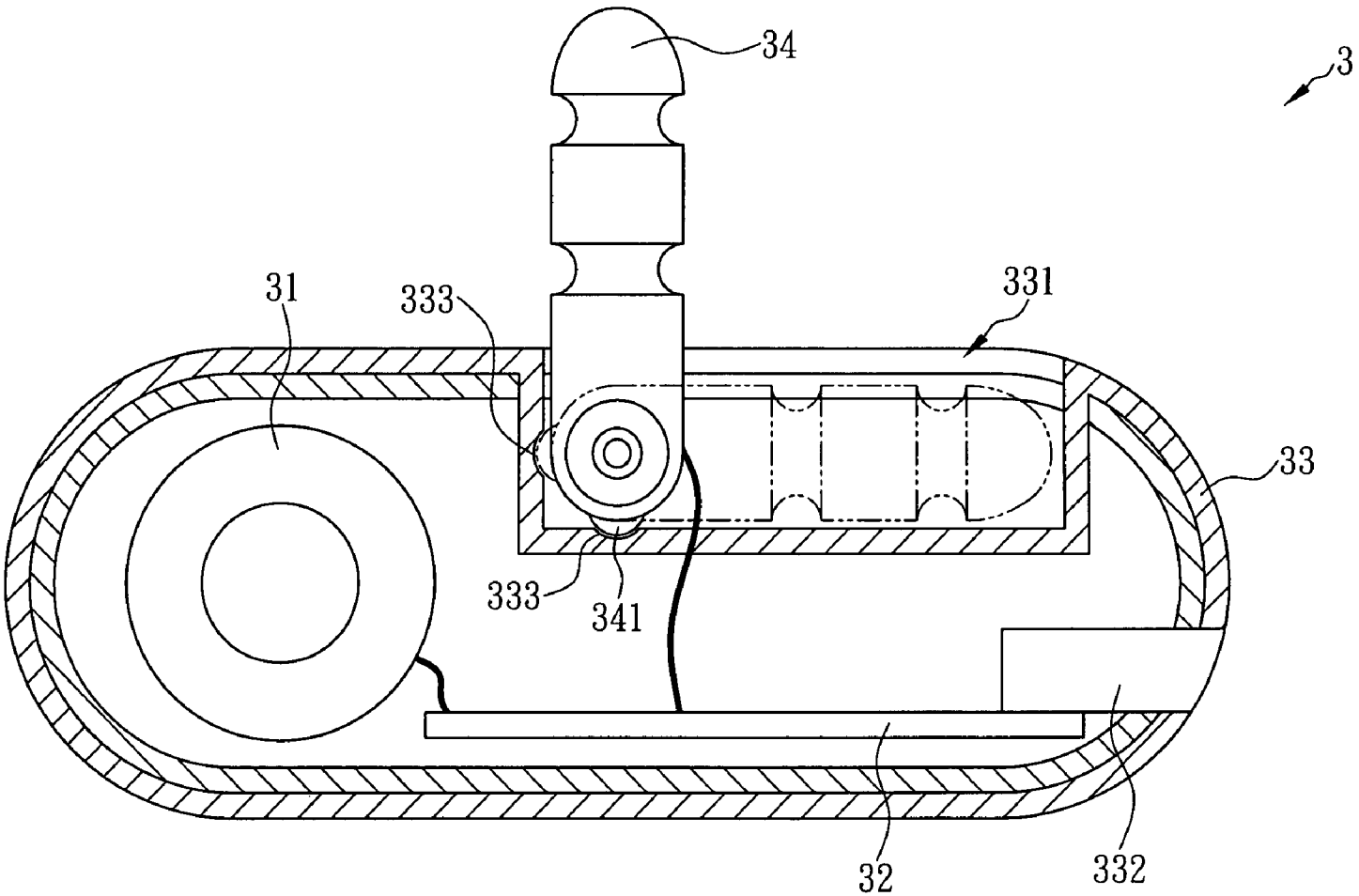
FIG. 3 is a sectional view of a loudspeaker structure according to the present invention.
Figure 4A:
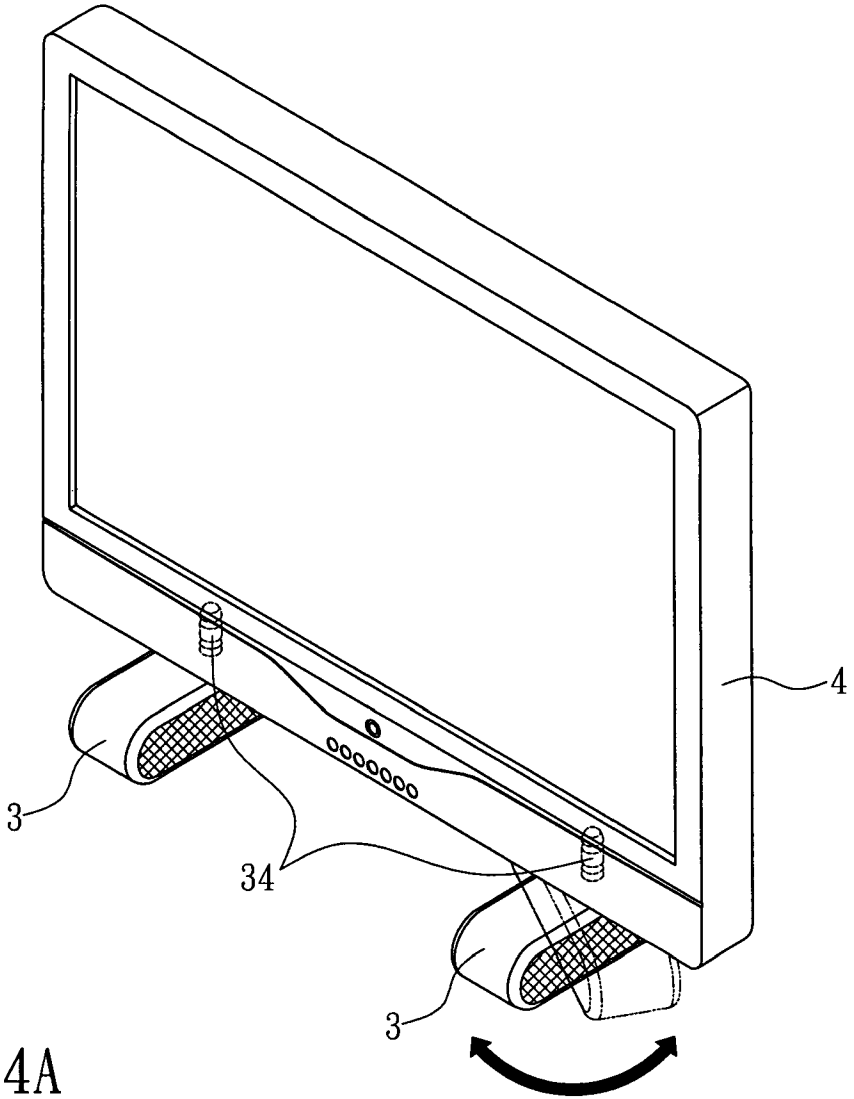
FIG. 4A is a perspective view showing two loudspeaker structures of the present invention installed at the bottom of a display.

Referring to FIG. 3, the present invention provides a detachable loudspeaker structure 3 having both audio and supporting functions, wherein the loudspeaker structure 3 includes a loudspeaker 31, a circuit board 32, a housing 33, and a signal connector 34. The housing 33 has a receiving space inside for receiving the loudspeaker 31 and the circuit board 32. The top surface of the housing 33 is further provided with a receiving groove 331 in which one end of the signal connector 34 is pivotally connected, thus allowing the other end of the signal connector 34 to be completely received in or rotated out of the receiving groove 331. The loudspeaker 31 is electrically connected to the circuit board 32 by a transmission line so as to receive audio signals from the circuit board 32 and transmitting the audio content of the audio signals. The circuit board 32 is electrically connected to the signal connector 34 by another transmission line so as to receive audio signals from the signal connector 34. Referring to FIG. 4A in conjunction with FIG. 3, once the signal connectors 34 of the two loudspeaker structures 3 shown in FIG. 4A are inserted respectively into the audio output ports provided on the bottom surface of a display 4, the signal connectors 34 can receive audio signals from the display 4 so as for the circuit boards 32 to transmit the audio signals to the corresponding loudspeakers 31 for reproduction. At the same time, the loudspeaker structures 3 directly support the display 4 and are placed on a flat surface (e.g., a desktop). A user can use the loudspeaker structures 3 as supporting bases of the display 4, without having to buy additional stands for supporting the display 4; consequently, the purchase cost is reduced on the user's side. As the loudspeaker structure 3 of the present invention functions as both a loudspeaker and a supporting base, the space taken by the display 4 and the loudspeaker structures 3 connected thereto is substantially smaller than if the audio and supporting functions of the loudspeaker structures 3 are implemented by separate devices.

Referring to FIG. 3, to ensure that the distal end of the signal connector 34, once rotated out of the receiving groove 331, can be securely held at the predetermined position, the pivotally connected end of the signal connector 34 is provided with a projection 341, and the inner wall of the receiving groove 331 is formed with a plurality of recesses 333. The projection 341 can be engaged in any of the recesses 333 so as to position the pivotally connected end of the signal connector 34 at different angles. Therefore, when the signal connector 34 is rotated out of the receiving groove 331, the engagement between the projection 341 and the recesses 341 allows the signal connector 34 to be firmly inserted in an audio output port of the display 4 and prevents the signal connector 34 from getting loose due to an external shaking force. As such, the convenience of use of the loudspeaker structure 3 is significantly increased. Besides, referring to FIG. 4A, the two loudspeaker structures 3 are located at two bottom ends of the display 4 respectively to reduce the impact of vibrations, caused by sound propagation, on the display 4 and thereby maintain the quality of use of the display 4.

With reference to FIG. 4A in conjunction with FIG. 3, as the signal connectors 34 are connected respectively to the audio output ports of the display 4 by insertion only and are not further fastened, a user may adjust the angles between the loudspeaker structures 3 and the display 4 by rotating the housings 33 of the loudspeaker structures 3 (as indicated by the arrow in FIG. 4A) so as to change the directions in which sound propagates from the loudspeakers 31. The user may rotate the housings 33 according to room settings or his/her current seat position, thereby changing the sound propagation directions of the loudspeaker structures 3 and creating different surround sound effects.

Figure 4B:
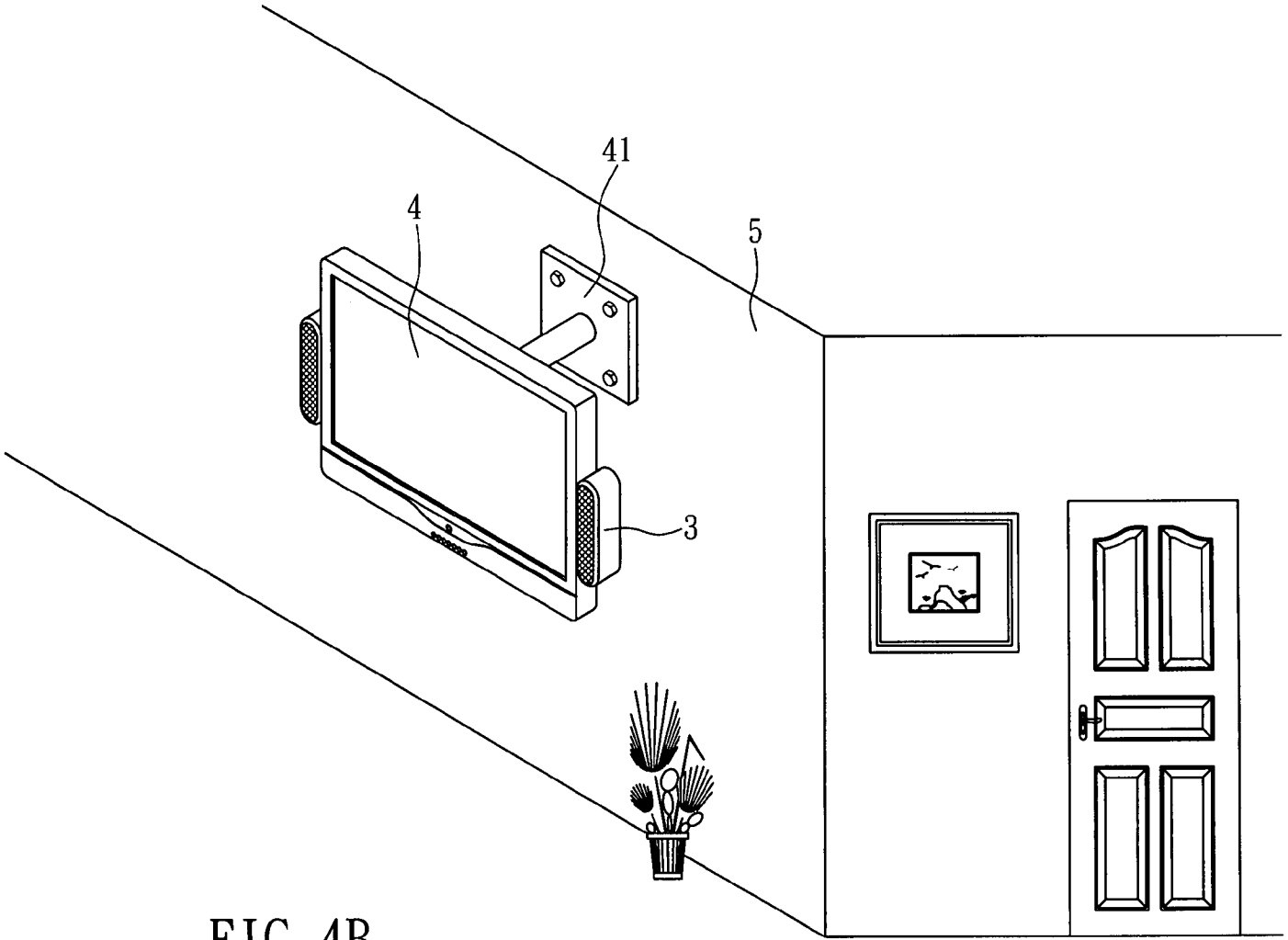
FIG. 4B is a perspective view showing the loudspeaker structure of the present invention installed on each of two lateral sides of a display.

Referring to FIG. 4B, when it is desired to mount the display 4 on a wall 5, instead of placing the display 4 on a desk as depicted in FIG. 4A, the user may install a wall mount 41 on the back of the display 4 so as to fix the display 4 to the wall 5 via the wall mount 41 in a cantilever manner. In this case, the loudspeaker structures 3, which are depicted in FIG. 4A as supporting bases, are directly removed from the bottom surface of the display 4, and the signal connectors 34 of the loudspeaker structures 3 are inserted into sides of the display 4, thus serving the sole function as loudspeakers capable of producing various sound propagation effects. As there is no need to buy additional mounts or brackets for installing the loudspeaker structures 3, the space which may otherwise be occupied by such wall mounts or brackets is freed. The user is also spared the trouble of drilling holes for the wall mounts or brackets. Besides, referring again to FIGS. 3 and 4B, as the signal connectors 34 of the loudspeaker structures 3 are connected to the display 4 by insertion so as to receive audio signals from the display 4, the user can directly connect the loudspeaker structures 3 to audio output ports at different positions of the display 4 without using any fastening tools (e.g., a wrench and screws). Thus, the installation positions of the loudspeaker structures 3 can be easily changed, and the convenience and versatility of use of the loudspeaker structures 3 are enhanced.

Figure 4C:
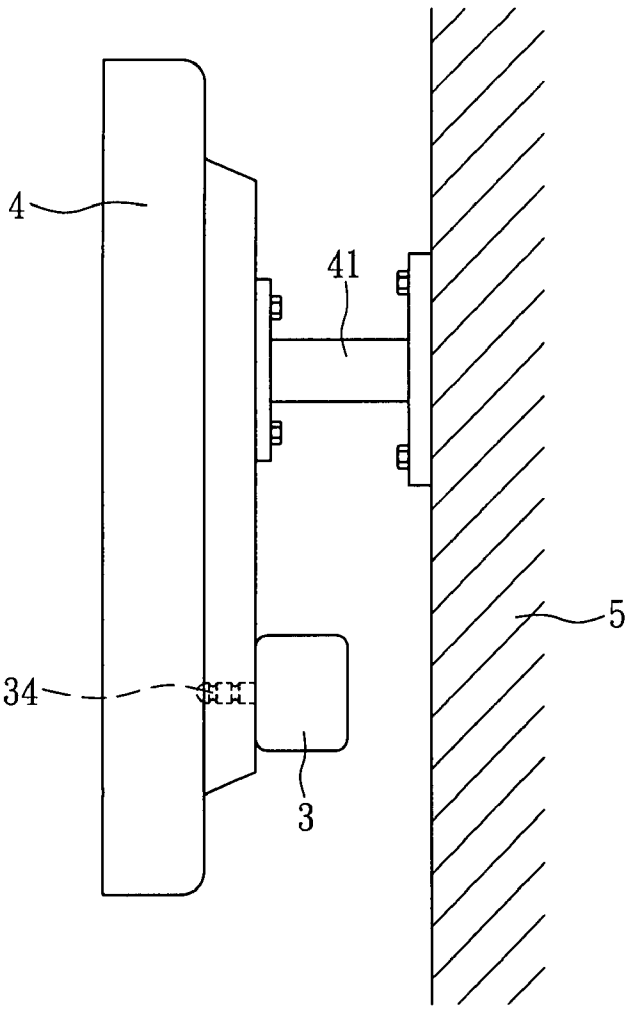
FIG. 4C is a side view showing the loudspeaker structure of the present invention installed on the back of a display.

Another preferred embodiment of the present invention is shown in FIG. 4C, wherein the wall 5 on which the display 4 is mounted is occupied by other objects (e.g., paintings) as well or has a relatively small area. In this case where the available space is limited, the loudspeaker structure 3 is inserted in an audio output port on the back of the display 4. Therefore, the mount or bracket which is otherwise required to install a conventional loudspeaker on the wall 5 is dispensed with, and the user is given the flexibility to install the loudspeaker structure 3 wherever appropriate. It should be pointed out that the loudspeaker structure 3 of the present invention not only can serve as a supporting base for the display 4, but also can be connected, by insertion, to the back of the display 4 when the display 4 is hung on the wall 5. In the latter case, the loudspeaker structure 3 serves as an ordinary loudspeaker and helps reduce the overall volume of the display 4 an advantageous feature unachievable by a conventional display that is equipped with a fixed base. Thus, the loudspeaker structure 3 of the present invention provides enhanced convenience of use.

Figure 4D:
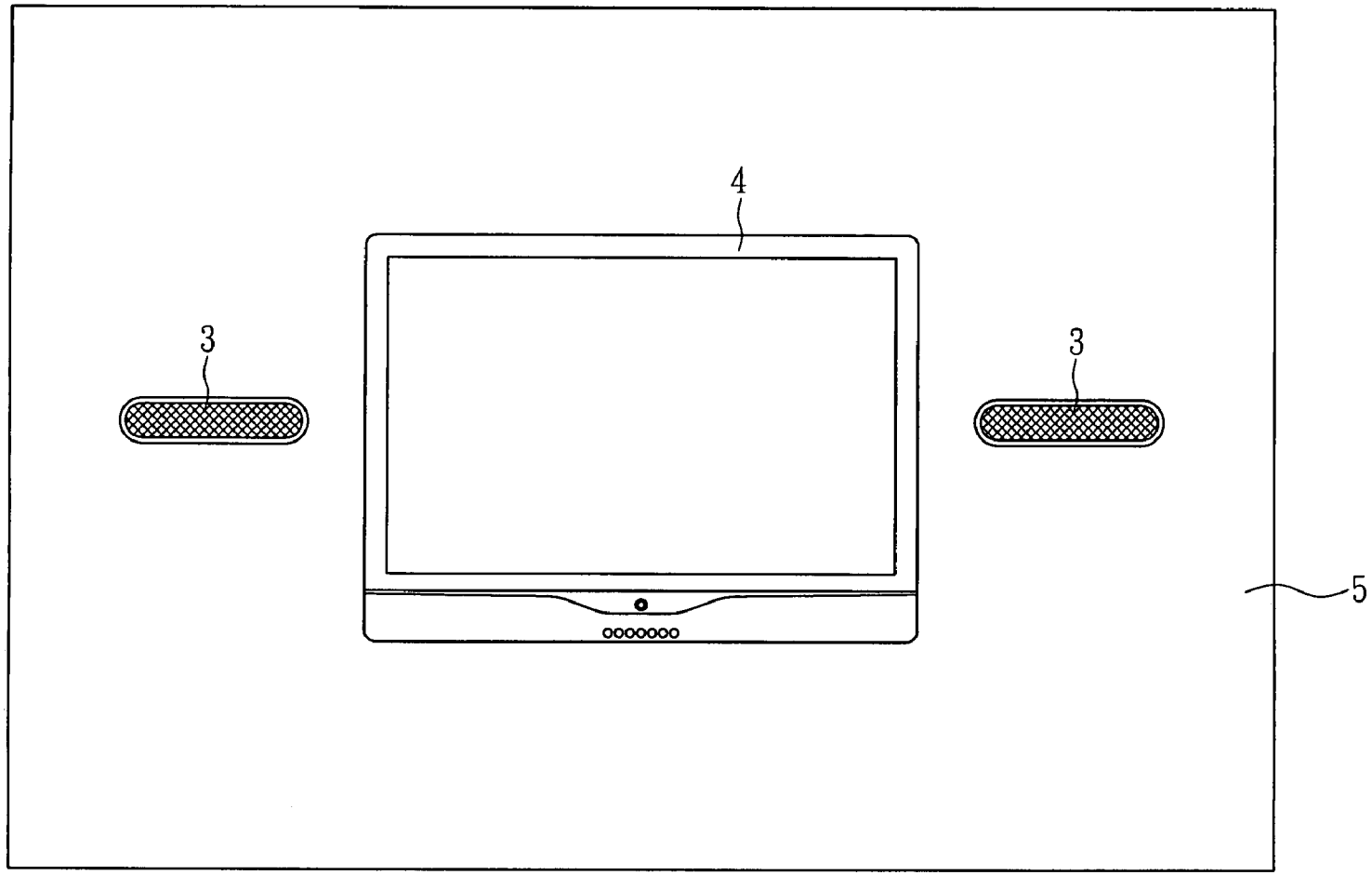
FIG. 4D is a front view showing two loudspeaker structures of the present invention being used as standalone units.

In addition, referring back to FIG. 3, the housing 33 is provided with an audio input port 332 electrically connected to the circuit board 32. The plug of an external audio source (e.g., a portable audio player or a mobile phone) can be inserted into the audio input port 332, thus allowing audio signals to be transmitted from the plug of the external audio source to the loudspeaker 31 via the circuit board 32 and be received and reproduced by the loudspeaker 31. Once the signal connector 34 is received in the receiving groove 331, the user can insert the plug of an external audio source into the audio input port 332, so that the loudspeaker 31 can receive and reproduce audio signals transmitted from the external audio source. Besides, referring to FIG. 4D in conjunction with FIG. 3, the signal connectors 34 are not inserted into the audio output ports of the display 4 but are inserted respectively into audio output ports (not shown) formed on the wall 5. In this case, the loudspeaker structures 3 are securely connected to and supported on the wall 5 by means of the signal connectors 34 and can receive audio signals from the audio output ports on the wall 5 also by means of the signal connectors 34. Thus, the loudspeaker structures 3 work as standalone loudspeakers, and the occasions in which the loudspeaker structure 3 of the present invention can be used are increased. In other words, the applicability of the disclosed loudspeaker structure 3 is effectively extended.

While the invention has been described by means of specific embodiments, numerous modifications and variations could be made thereto by those skilled in the art without departing from the scope and spirit of the invention set forth in the claims.

What is claimed is:

1. A detachable loudspeaker structure having both audio and supporting functions, the loudspeaker structure comprising:

a loudspeaker;

a circuit board electrically connected to the loudspeaker and configured to transmit audio signals to the loudspeaker for reproduction;

a housing having a receiving space for receiving the loudspeaker and the circuit board, the housing having a receiving groove disposed in a top surface of the housing, wherein the housing further comprises an audio input port electrically connected to the circuit board and configured to receive audio signals from an external audio source and transmit the audio signals received to the circuit board;

a signal connector electrically connected to the circuit board and having an end pivotally connected inside the receiving groove, a projection disposed in the end of the signal connector so the signal connector may be completely received in the receiving groove or, when an opposite end of the signal connector is rotated out of the receiving groove, be inserted into an audio output port on a bottom surface of a display, such that the bottom surface of the display is supported on the top surface of the housing and the signal connector receives the audio signals from the display and transmits the audio signals to the circuit board; and wherein the receiving groove further comprises a recess disposed corresponding in position to the end of the signal connector, and the recess engaged with the projection.

* * * * *